US006910412B2

(12) United States Patent
Ko

(10) Patent No.: US 6,910,412 B2
(45) **Date of Patent: *Jun. 28, 2005**

(54) GARBAGE CONTAINER WITH A COMPRESS DEVICE FOR COMPRESSING THE GARBAGE RECEIVED THEREIN

(76) Inventor: Wen-Hsiung Ko, No. 9, Lane 339, Pei Yang RD., Feng Yuan City, Taichung Hsien (TW)

( * ) Notice: Subject to any disclaimer, the term of this patent is extended or adjusted under 35 U.S.C. 154(b) by 221 days.

This patent is subject to a terminal disclaimer.

(21) Appl. No.: 10/352,965

(22) Filed: Jan. 29, 2003

(65) Prior Publication Data

US 2003/0233950 A1 Dec. 25, 2003

Related U.S. Application Data

(63) Continuation-in-part of application No. 10/173,599, filed on Jun. 19, 2002, now abandoned.

(51) Int. Cl.[7] ..... B30B 15/06
(52) U.S. Cl. ..... 100/229 A; 100/227
(58) Field of Search ..... 100/226, 227, 100/228, 229 A, 240, 245, 246, 247, 295

(56) References Cited

U.S. PATENT DOCUMENTS 5,090,309 A * 2/1992 Lai ..... 100/226
5,115,736 A * 5/1992 Rodolico et al. ..... 100/90
5,884,556 A * 3/1999 Klepacki et al. ..... 100/349
6,102,343 A * 8/2000 Grimesey et al. ..... 248/95
6,314,874 B1 * 11/2001 Martorella ..... 100/226
2003/0233949 A1 * 12/2003 Ko ..... 100/214

FOREIGN PATENT DOCUMENTS

EP 1364893 * 11/2003 ..... B65F/1/08

* cited by examiner

*Primary Examiner*—Ed Tolan
(74) *Attorney, Agent, or Firm*—Rosenberg, Klein & Lee

(57) ABSTRACT

A garbage container with a compress device includes a first cylinder having a first receiving space defined therein. A compress plate is reciprocally and movably received in the first cylinder for compressing the garbage in the garbage container. A cover is pivotally mounted on a top portion of the first cylinder. The cover has an opening defined therein and communicating with the first receiving space in the first cylinder. The cover includes a seat attached to a bottom of the cover and having an opening defined in the seat and corresponding to the opening in the cover. The opening in the cover allows a user's foot extending into the garbage container to step the compress plate for compressing garbage. A restituting device is mounted in the seat for providing a restitution force to the compress plate after compressing the garbage in the garbage container.

20 Claims, 15 Drawing Sheets

GARBAGE CONTAINER WITH A COMPRESS DEVICE FOR COMPRESSING THE GARBAGE RECEIVED THEREIN

CROSS-REFERENCE TO RELATED APPLICATION

The application is a Continuation-In-Part of Ser. No. 10/173,599, filed Jun. 19, 2002, now abandoned, and entitled "GARBAGE CAN CAPABLE OF COMPRESSING GARBAGE VOLUME".

BACKGROUND OF THE INVENTION

1. Field of the Invention

The present invention relates to a garbage container, and more particularly to garbage container with a compress device for compressing the garbage received therein.

2. Description of Related Art

A conventional garbage container in accordance with the prior art shown in FIG. 5 comprises a cylinder (8) with an opening (81) defined in a top portion of the cylinder and a receiving space (82) defined in the cylinder (8) for containing garbage.

The garbage that we throw into the garbage container usually is fluffy such that the garbage will occupy most of the receiving space (82) even that the garbage container receives some garbage and needs to be often cleaned. For using the receiving space in full, the user usually compresses the garbage in the garbage container by his/her hands or foot. However, the user may be hurt by a sharpened object or a broken glass object during compressing the garbage in the garbage container.

Consequently, a conventional garbage container with a compress device is marketed. With reference to FIGS. 17 and 18, the conventional garbage container comprises a cylinder (9) including a receiving space (91) defined in the cylinder (9). The receiving space has an upper opening (not numbered). A ring (92) is slidably mounted in the cylinder (9) and a spring (93) in compressively received in the cylinder (9). The spring has a first end abutting a bottom of the cylinder (9) and a second end abutting the ring (92). A bag (95) for receiving garbage (95) in received within the spring (93). The edge of the bag (95) is clamped between the ring (92) and the second end of the spring (93). A cover (94) is pivotally mounted on the ring (92) for closing the receiving space (91) and has a diameter smaller than that of the receiving space (91).

The garbage in the bag (95) is compressed when downward stepping the cover (94) and the restitution force of the spring (93) will push the ring (92) to the original position after the garbage being compressed to reduce volume for containing more garbage in the bag (95). However, the air in the bag (95) cannot drain from the bag (95) and is compressed when downward stepping the cover (94) and the ring (92). The compressed air in the bag (95) act against the user such that the garbage may not be fully compressed and the edge of the bag (95) will detach from the ring (92) and the spring (93) when the pressure of the compressed air in the bag (95) is greater than the clamping force between the ring (93) and the ring (92).

The present invention has arisen to mitigate and/or obviate the disadvantages of the conventional garbage container.

SUMMARY OF THE INVENTION

The main objective of the present invention is to provide an improved garbage container with a compress device for compressing the garbage that is received in the garbage container in accordance with the present invention.

To achieve the objective, the garbage container in accordance with the present invention comprises a first cylinder having a first receiving space defined therein. A compress plate is reciprocally and movably received in the first cylinder for compressing the garbage in the garbage container. A cover is pivotally mounted on a top portion of the first cylinder. The cover has an opening defined therein and communicating with the first receiving space in the first cylinder. The cover includes a seat attached to a bottom of the cover and having an opening defined in the seat and corresponding to the opening in the cover. The opening in the cover allows a user's foot extending into the garbage container to step the compress plate for compressing garbage. A restituting, device is mounted in the seat for providing a restitution force to the compress plate after compressing the garbage in the garbage container.

Further benefits and advantages of the present invention will become apparent after a careful reading of the detailed description with appropriate reference to the accompanying drawings.

DETAILED DESCRIPTION OF THE INVENTION

Figure 1:
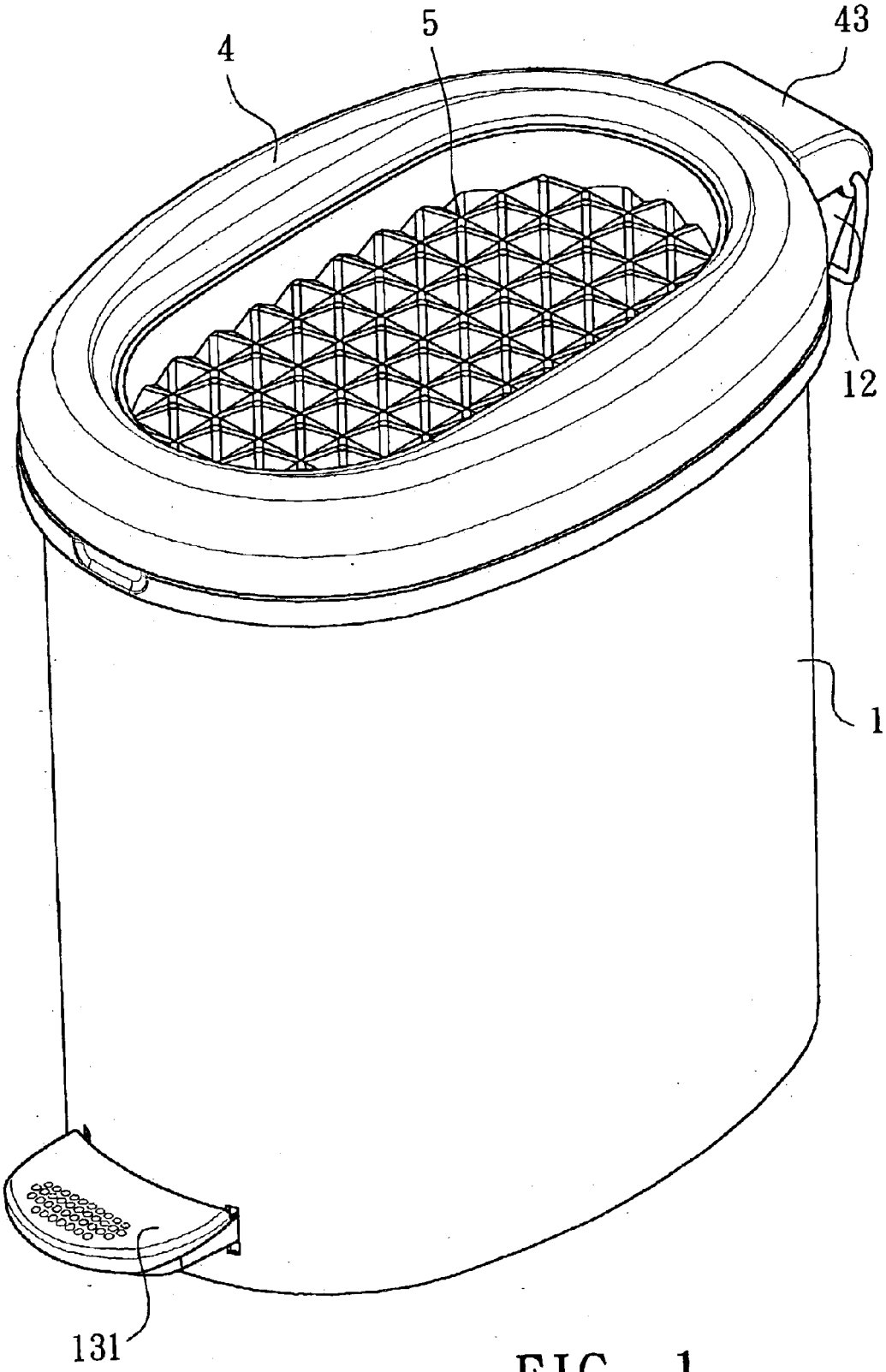
FIG. 1 is a perspective view of a garbage container with a compress device for compressing the garbage that is received in therein in accordance with the present invention.
Figure 2:
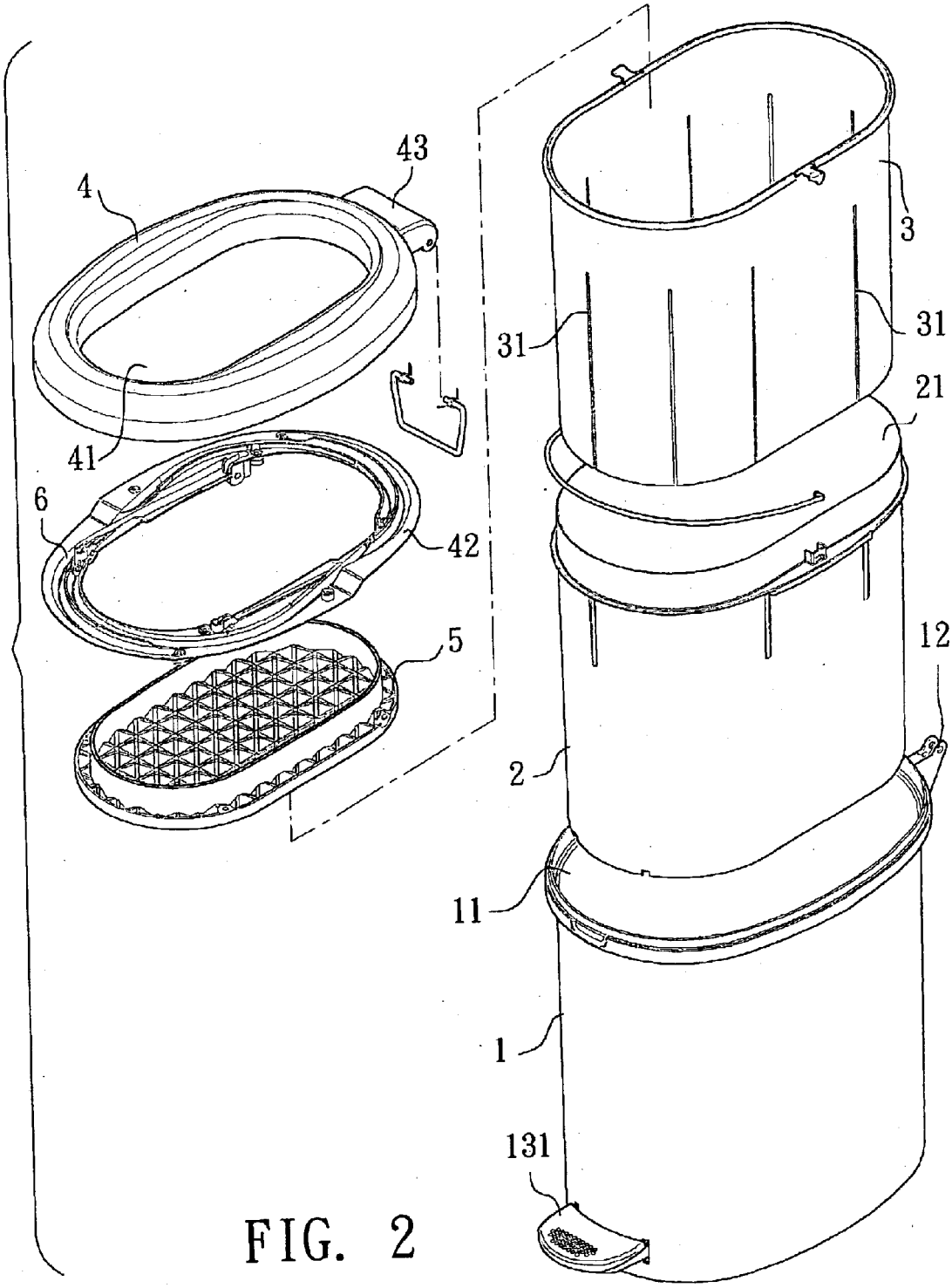
FIG. 2 is an exploded perspective view of the garbage container in FIG. 1.
Figure 3:
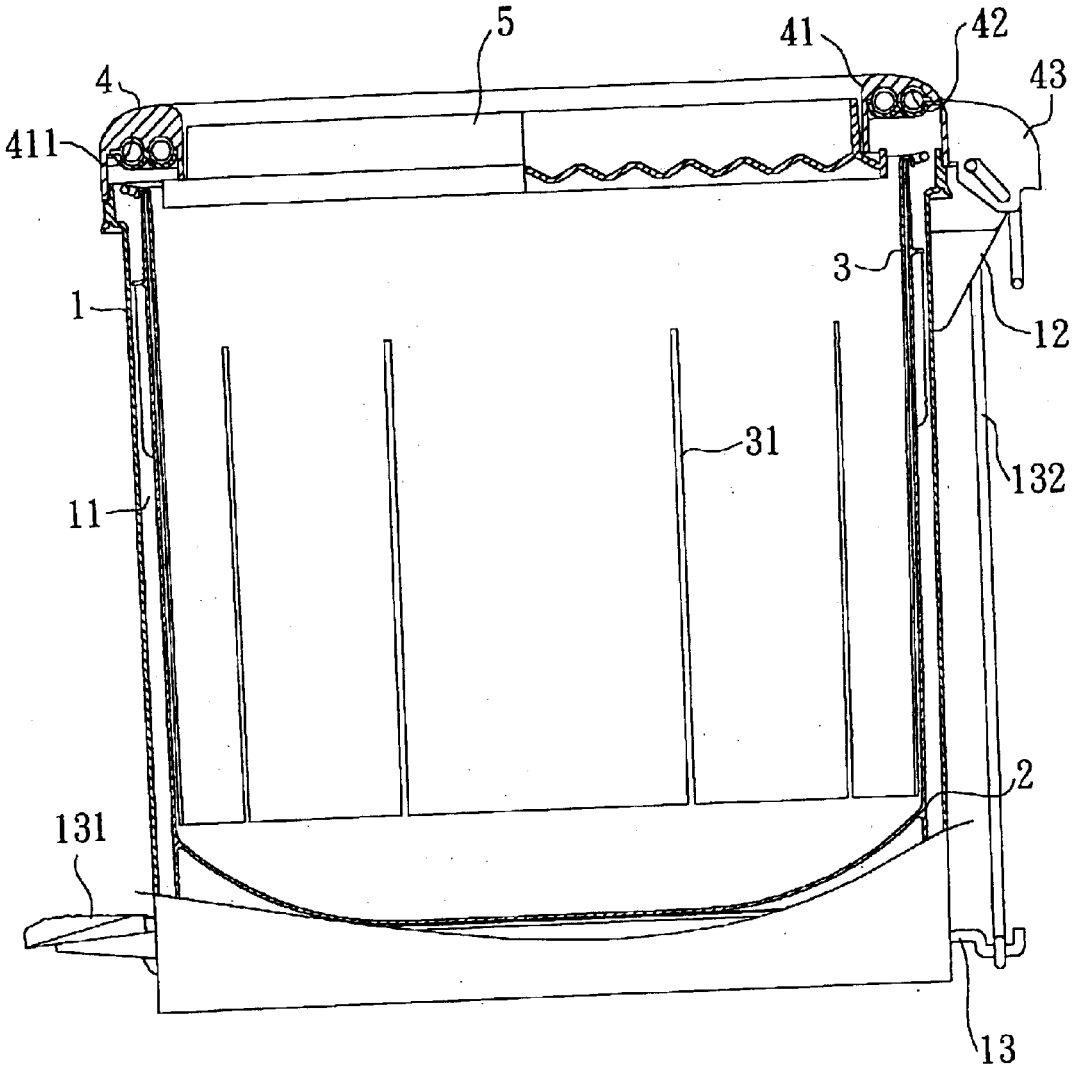
FIG. 3 is a side cross sectional view of the garbage container in FIG. 1.
Figure 4:
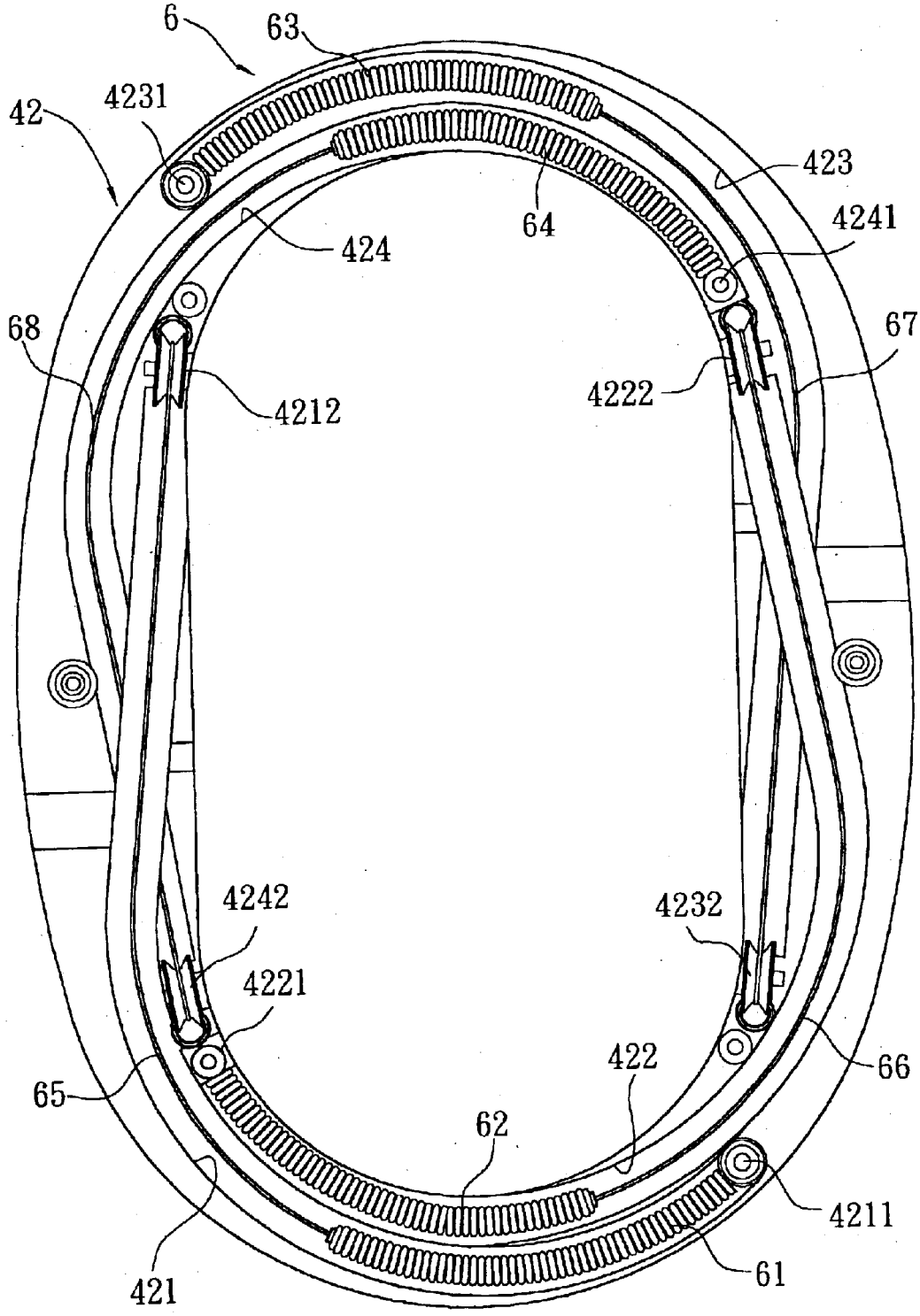
FIG. 4 is a top plan view of a restituting device of the garbage container in FIG. 1.
Figure 5:
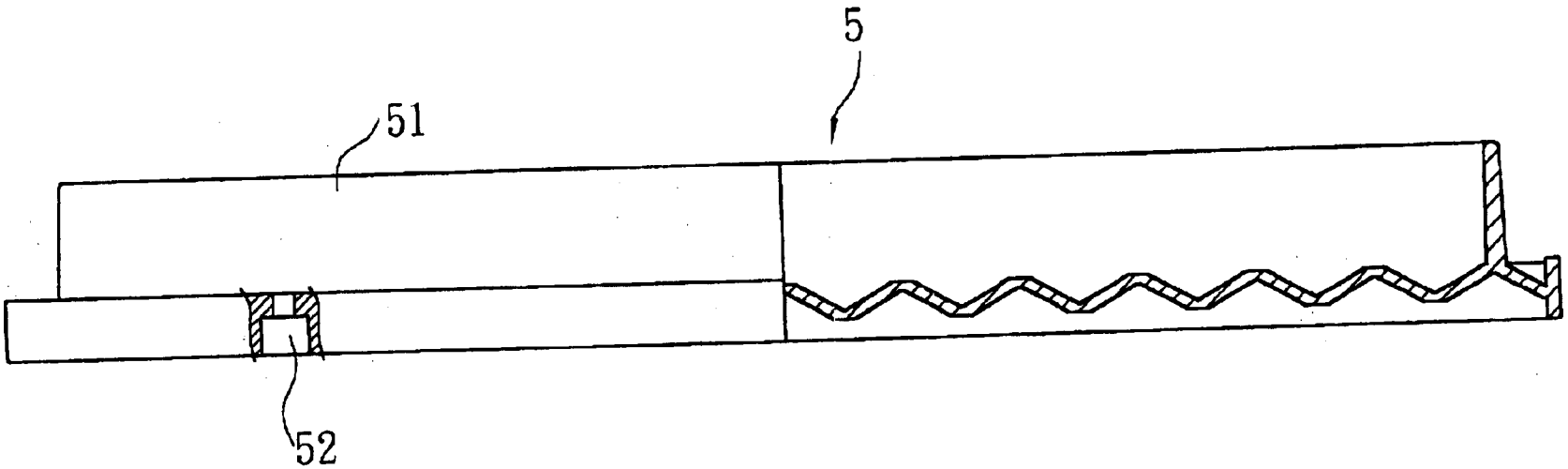
FIG. 5 is a side plan view of a compress plate of the garbage container in FIG. 1 in partial section.
Figure 6:
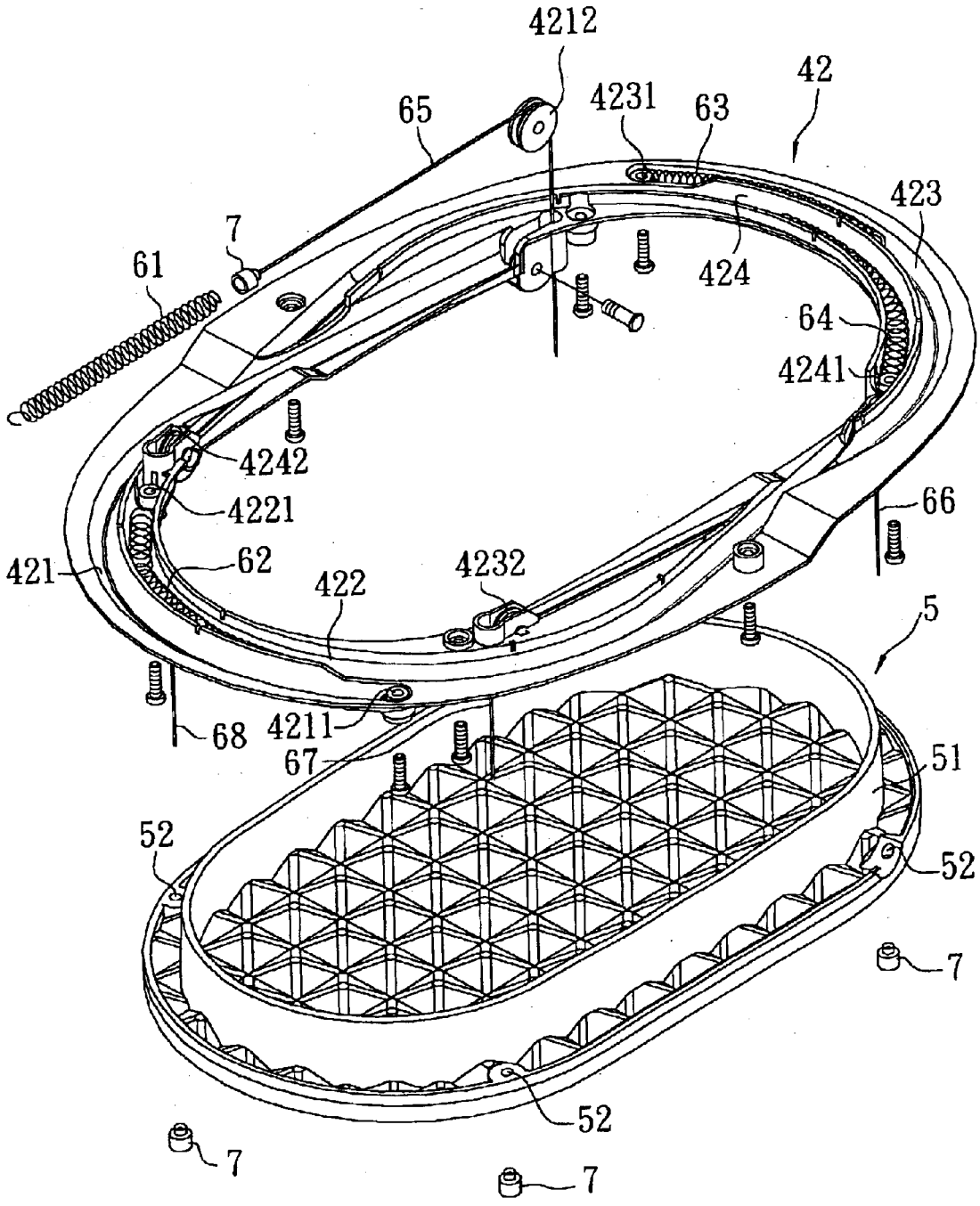
FIG. 6 is a partially exploded perspective view of a seat, the restituting device and the compress plate of the garbage container in FIG. 1.

Referring to the drawings and initially to FIGS. 1–6, a the garbage container with a compress device in accordance with the present invention comprises first cylinder (1), a second cylinder (2) received in the first cylinder (1), a third cylinder (3) received in the second cylinder (2) for holding open a bag (not shown) for receiving garbage. A cover (4) is pivotally mounted on a top portion of the first cylinder (1) and a compress plate (5) is mounted under the cover (4) and separable relative to the cover (4). The compress plate (5) is reciprocally and longitudinally moved in the third cylinder (3). A restituting device (6) mounted in the cover (4) to provide a restitution force to the compress plate (5).

The first cylinder (1) includes a first receiving space (11) therein for receiving the second cylinder (2). The first cylinder (1) has a lower close end and an upper open end. A first pilot seat (12) laterally extends from an outer periphery of the first cylinder (1) for pivotally connected to the cover (4). A shaft (13) is mounted in a bottom of the first cylinder (1) and laterally extends through the first cylinder (1). The shaft (13) has a first end formed with a step portion and a second end opposite to the first end of the shaft (13). A linkage (132) has a first end pivotally connected to the second end of the shaft (31) and a second end pivotally connected to the cover (4) for lifting the cover (4).

The second cylinder (2) is received in the first receiving space (11) in the first cylinder (1) and includes a second receiving space (21) defined in the second cylinder (2) for receiving the third cylinder (3). The second cylinder (2) has a lower close end and an upper open end.

The third cylinder (3) has two opposite open ends and is received in the second receiving space (21) in the second cylinder (2) to hold open the bag such that the bag is received between the second cylinder (2) and third cylinder (3). Multiple slits (31) are defined in the third cylinder (3) and extend to a bottom of the third cylinder (3) such that the third cylinder (3) can slightly expand for more convenient holding open the bag.

The cover (4) has a shape corresponding to that of the first cylinder (1). The cover (4) includes an opening (41) centrally defined therein to allow the user's foot extending into the garbage container to step the compress plate (5) for compressing garbage. A second pivot seat (43) laterally extends from the cover (4) for pivotally connected to the first pivot seat (12) of the first cylinder (1). An annular groove (411) is defined in a bottom of the cover (4) and surrounds the opening (41) in the cover (4). A seat (42) is snapped into the annular groove (411) and mounted on the bottom of the cover (4). The seat (42) has an opening (not numbered) defined therein and corresponding to the opening (41) in the cover (4). The seat (42) includes a first groove (421), a second groove (422), a third groove (423) and a fourth groove (424) defined in an upper side of the seat (42) and surrounding the opening (41) in the seat (42) for receiving the restituting device (6). The first groove (421) and the third groove (423) correspond to each other. The second groove (422) and the fourth groove (424) correspond to each other. A first stub (4211) upwardly extends from a bottom and near a first end of the first groove (421). A second stub (4221) extends from a bottom and near a first end of the second groove (422). A third stub (4231) extends from a bottom and near a first end of the third groove (423). A fourth stub (4241) extends from a bottom and near a first end of the fourth groove (424). A first roller (4212) is pivotally mounted on the upper side of the seat (42) near a second end of the first groove (421). A second roller (4222) is pivotally mounted on the upper side of the seat (42) near a second end of the second groove (422). A third roller (4232) is pivotally mounted on the upper side of the seat (42) near a second end of the third groove (423). A fourth roller (4242) is pivotally mounted on the upper side of the seat (42) near a second end of the fourth groove (424).

The compress plate (5) is mounted under the seat (42) of the cover (4). The compress plate (5) has a shape corresponding to that of the cover (4) and greater than that of the opening (41) in the cover (4). The compress plate (5) has a skirt (51) upwardly extending therefrom within the opening (41) in the cover (4). The compress plate (5) has four sunken holes (52) defined in a bottom of the compress plate (5). Each sunken hole (52) corresponds to a corresponding one of the rollers (4212, 4222, 4232, 4242) of the cover (4).

The restituting device (6) includes a first resilient member (61) received in the first groove (421) in the seat (42). The first resilient member (61) has a first end securely connected to the first stub (4211) and a second end connected to a first end of a first wire (65). The first wire (65) has a second end extending through the seat (42) and secured in a corresponding one of the four sunken holes (52) in the compress plate (5) after winding the first roller (4212). A second resilient member (62) is received in the second groove (422). The second resilient member (62) has a first end securely connected to the second stub (4221) and a second end connected to a firs end of a second wire (66). The second wire (66) has a second end extending through the seat (42) and secured in a corresponding one of the four sunken holes (52) in the compress plate (5) after winding the second roller (4222). A third resilient member (63) is received in the third groove (423). The third resilient member (63) has a first end securely connected to the third stub (4231) and a second end connected to a first end of a third wire (67). The third wire (67) has a second end extending through the seat (42) and secured in a corresponding one of the four sunken holes (52) in the compress plate (5) after winding the third roller (4232). A fourth resilient member (64) is received in the fourth groove (424). The fourth resilient member (64) has a first end secures on the fourth stub (4241) and a second end connected to a first end of a fourth wire (68). The fourth wire (68) has a second end extending through the seat (42) and secured in a corresponding one of the four sunken holes (52) in the compress plate (5). In the preferred embodiment of the present invention, the resilient members (61, 62, 63, 64) are springs.

Figure 7:
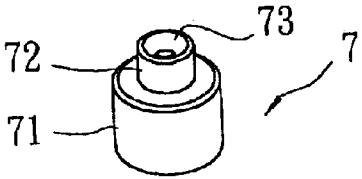
FIG. 7 is a perspective view of an end piece o the garbage container in FIG. 1.
Figure 8:
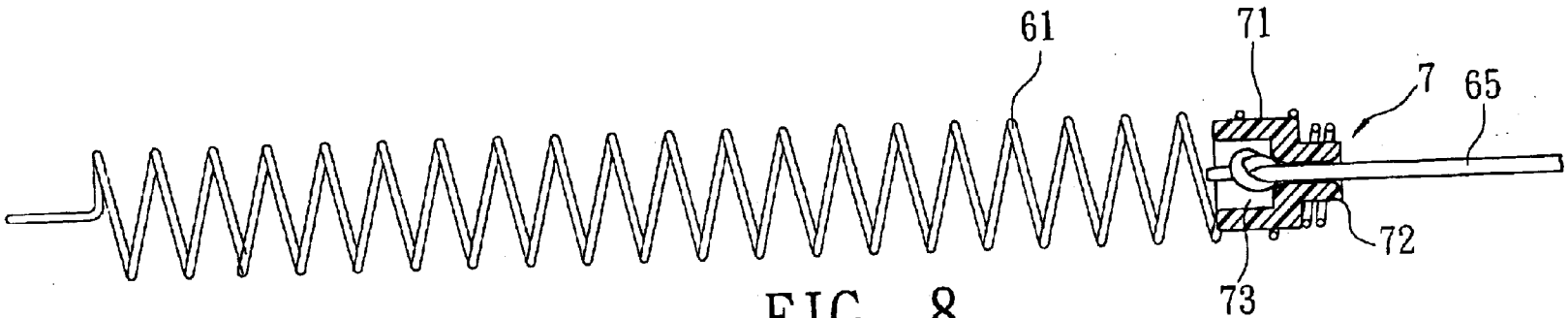
FIG. 8 is a cross sectional plan view of the end piece for showing the end piece connected with a resilient member and a wire.
Figure 9:
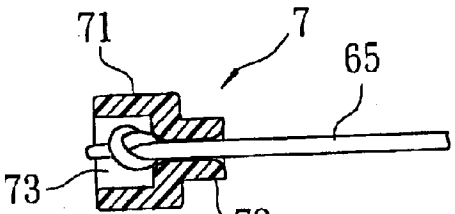
FIG. 9 is a cross sectional plan view of the end piece for showing the end piece connected with a wire.

With reference to FIGS. 7–9, each end of the wires (65, 66, 67, 68) has an end piece (7) mounted thereon. The end piece (7) has a first section (71) and the second section (72) longitudinally extending from the first section of the end piece (7). The first section (71) has a diameter greater than that of the second section (72). A sunken hole (73) is defined in the end piece (71) for receiving the distal ends of each of the wires (65, 66, 67, 68) due to a tie formed on the ends of each of the wires (65, 66, 67, 68). The sunken hole (73) has a shape corresponding to that of the end piece (7) and extending through the end piece (7). The end piece (7) mounted on the first end of each of the wires (65, 66, 67, 68) is securely received in the second end of each of the resilient members (65, 66, 67, 68) and the end piece (7) mounted on the second end of each of the wires (65, 66, 67, 68) is received in a corresponding one of the four sunken holes (52) in the compress plate (5).

Figure 10:
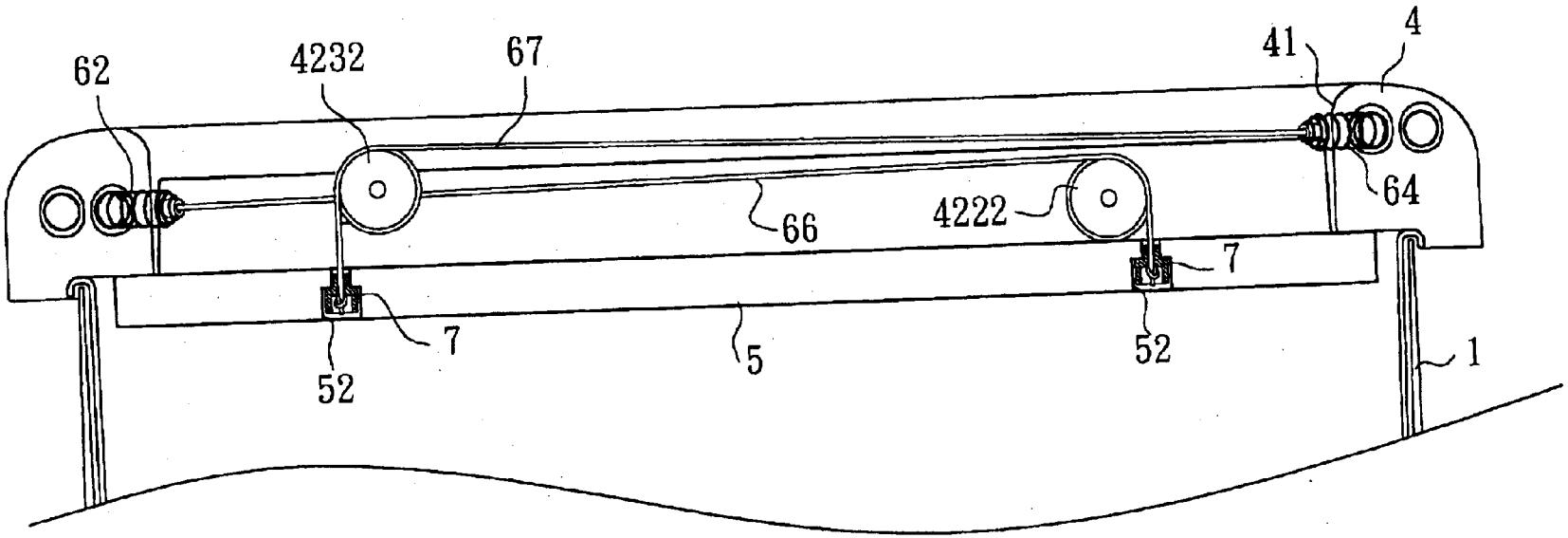
FIG. 10 is a side plan view of the cover and the compress plate for showing the compress plate pulled to abut the cover by the restituting device.
Figure 11:
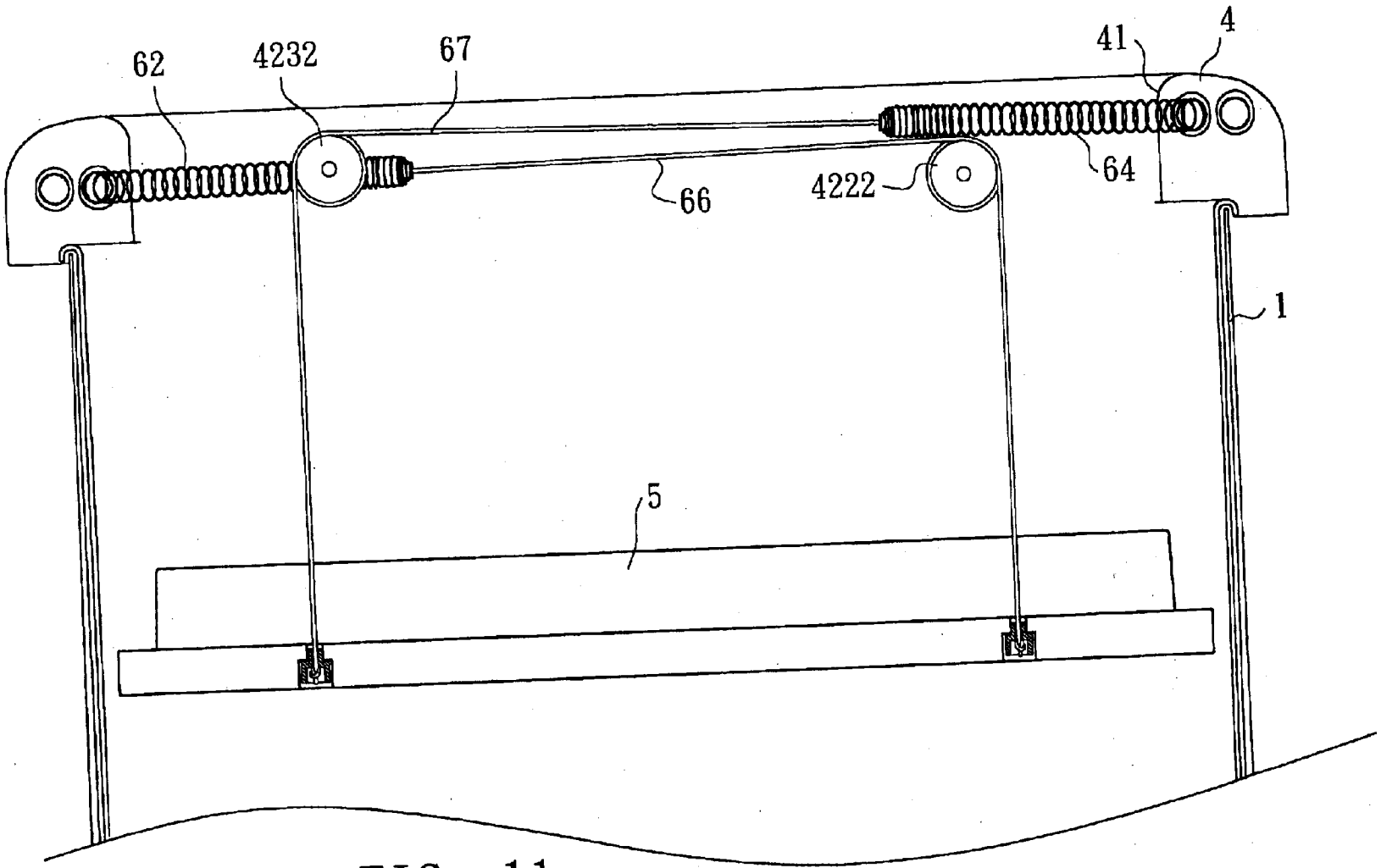
FIG. 11 a side plan view of the cover and the compress plate for showing the compress plate downward moved and pulling the restituting device.
Figure 12:
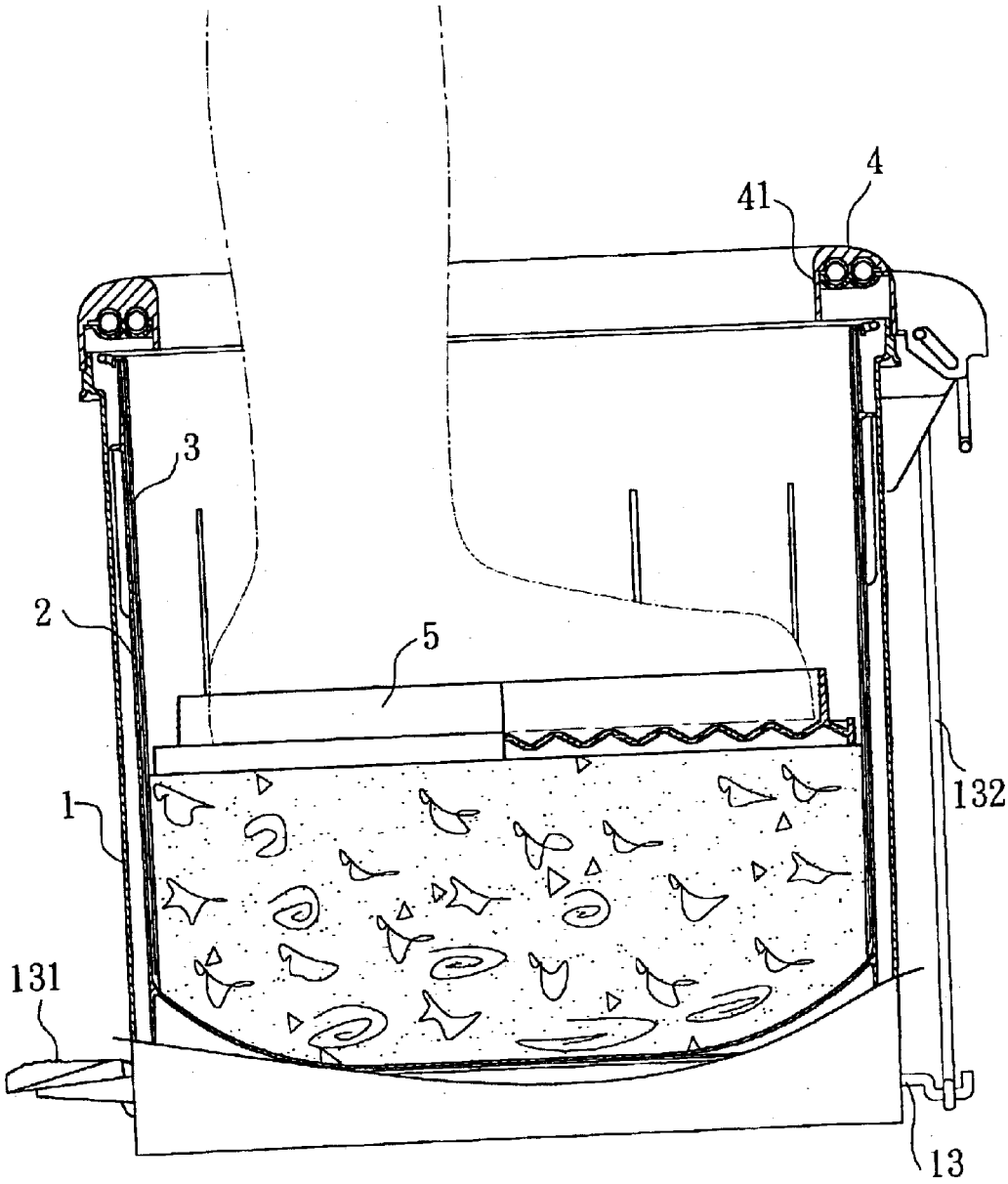
FIG. 12 is a side plan view of the garbage container in FIG. 1 when compressing the garbage.

With reference to FIGS. 10–12, the third cylinder (3) holds open the bag and received in the second cylinder (2). The user can step the step portion (131) such that the cover (4) and the compress plate (5) are lifted, and the user can easily throw garbage into the garbage container. The user can downward step the compress plate (5) to compress the volume of the garbage received in the garbage container when the garbage is in a certain volume. The resilient members (61, 62, 63, 64) are pulled and extend by the wires (65, 66, 67, 68) when the compress plate (5) is downward moved in the third cylinder (3). The compress plate (5) will move to the original position thereof when the user stops stepping the compress plate (5) and the garbage is compressed due to the restitution force of the resilient members (61, 62, 63, 64).

As described above, the garbage container with a compress device in accordance with the present invention includes several advantages as follow.

1. The third cylinder (3) holds open the bag to receive garbage such that the third cylinder (3) can prevent the bag from being scraped and cleaved by the sharpened object in the bag during compressing.

2. The compress plate (5) can be moved to the bottom of the second cylinder (2) such that the garbage can be fully compressed because the restituting device (6) is mounted in the cover.

3. The air in the bag drains from a gap between the third cylinder (3) and the compress plate (5) because the compress plate (5) is movably received in the third cylinder (3) such that the bag does not expand because the compressed air drains from the gap between the third cylinder (3) and the compress plate (5).

Figure 13:
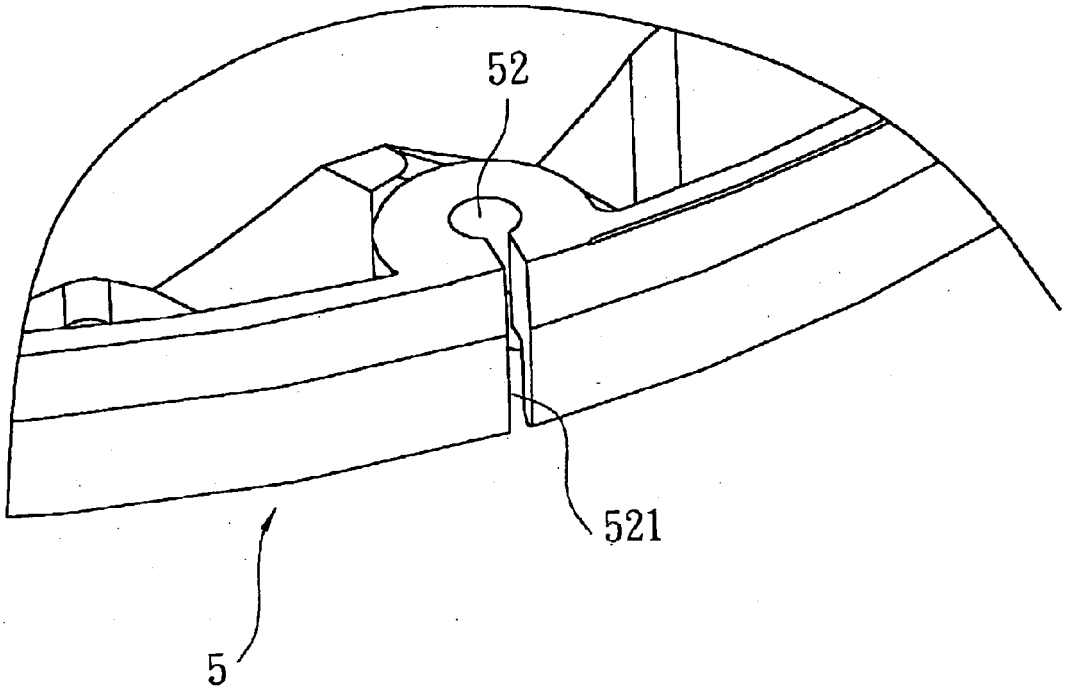
FIG. 13 is a partially perspective view of a second embodiment of the compress plate in accordance with the present invention.
Figure 14:
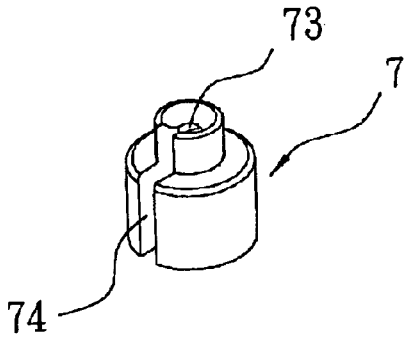
FIG. 14 is a perspective view of a second embodiment of the end piece in accordance with the present invention.

With reference to FIGS. 13 and 14 that show another embodiment of the compress plate (5) and the end piece (7), the compress plate (5) has four slots (521) defined therein and each slot (521) is parallel to an axis of a corresponding one of the four sunken hole (52) in the compress plate (5) the laterally communicating with a corresponding one of the four sunken hole (52) in the compress plate (5) for easily mounting the second end of each of the wires (65, 66, 67, 68) in the sunken hole (52) in the compress plate (7). The end piece (7) has a channel (74) longitudinally defined in an outer periphery of the end piece (7) and laterally communicating with the sunken hole (73) in the end piece (7) for easily mounting the opposite ends of each of the wires (65, 66, 67, 68) in a corresponding one of the end pieces (7).

Figure 15:
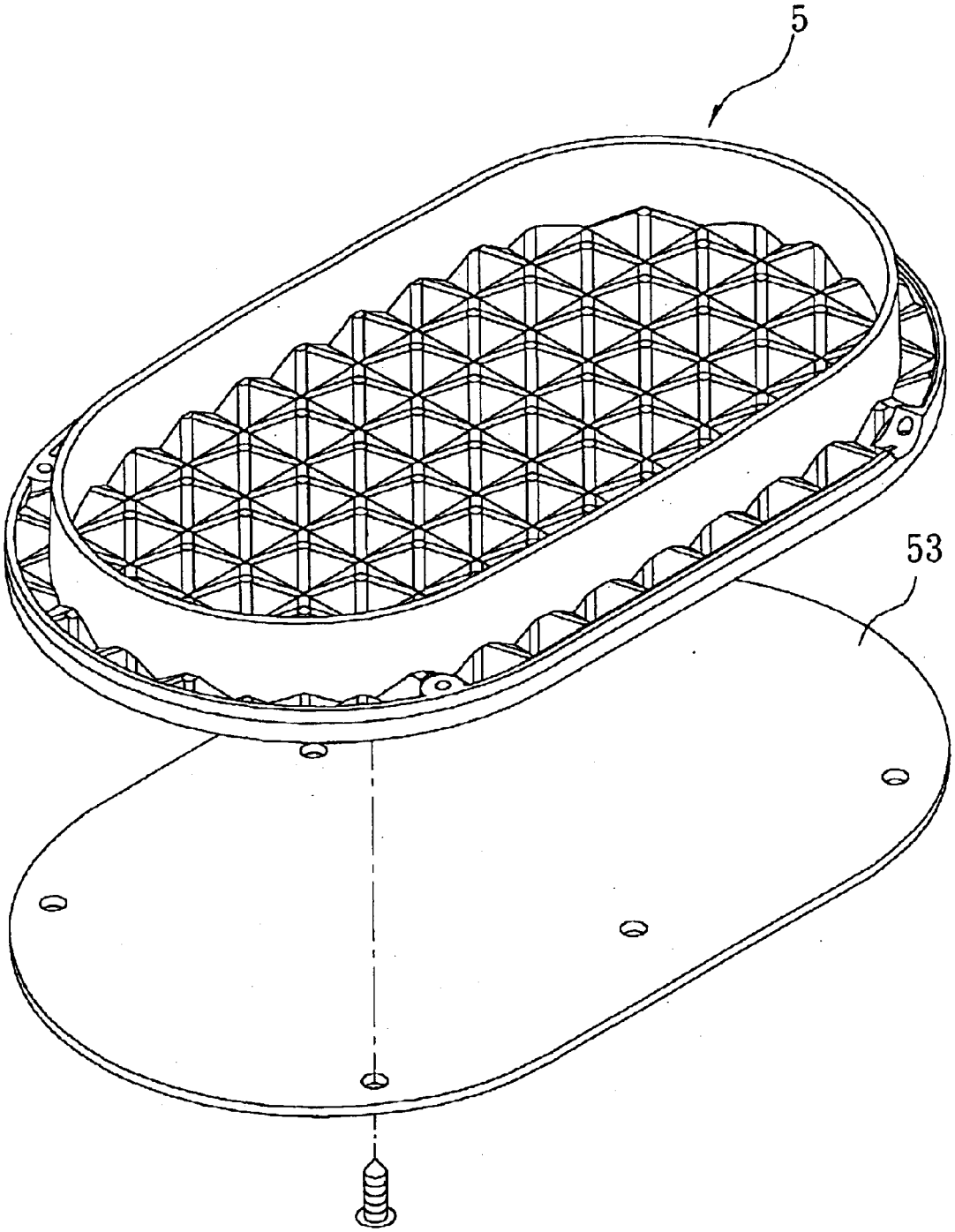
FIG. 15 is an exploded perspective of a third embodiment of the compress plate in accordance with the present invention.
Figure 16:
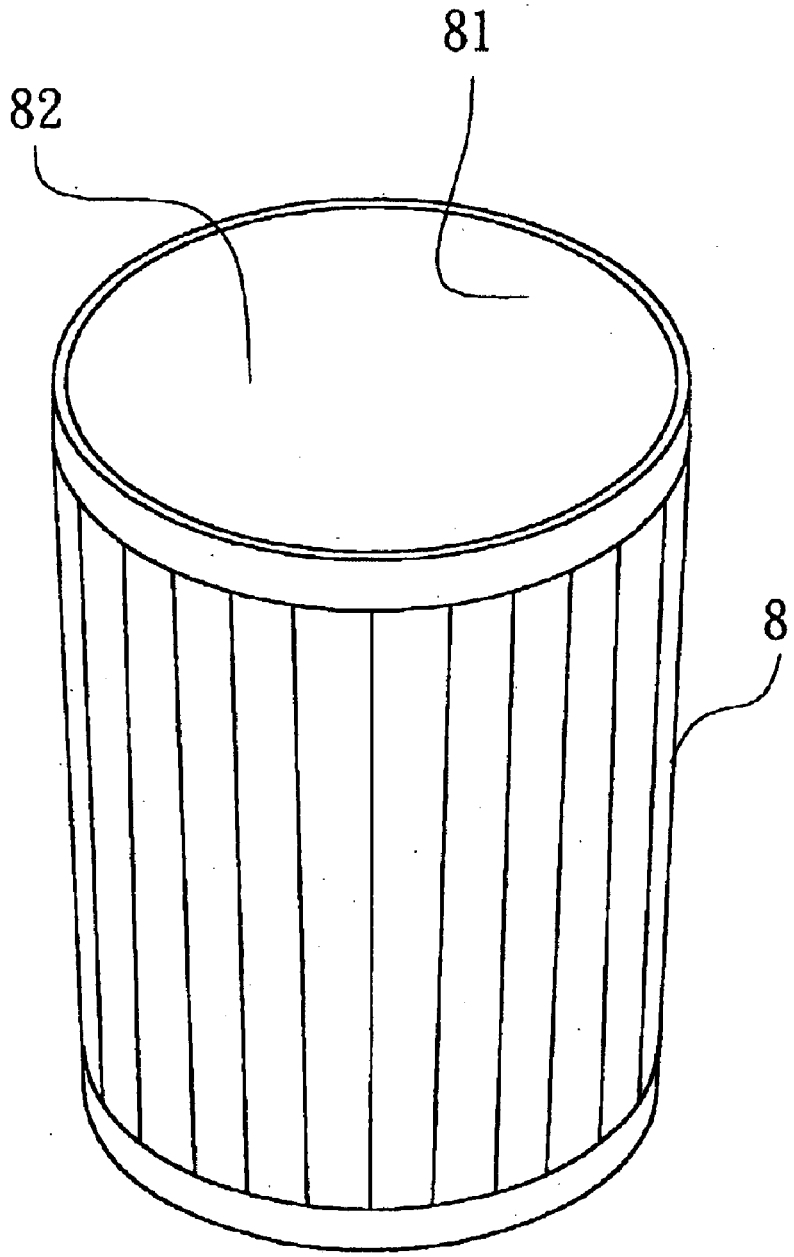
FIG. 16 PRIOR ART
FIG. 16 is a perspective view of a conventional garbage container in accordance with the prior art.
Figure 17:
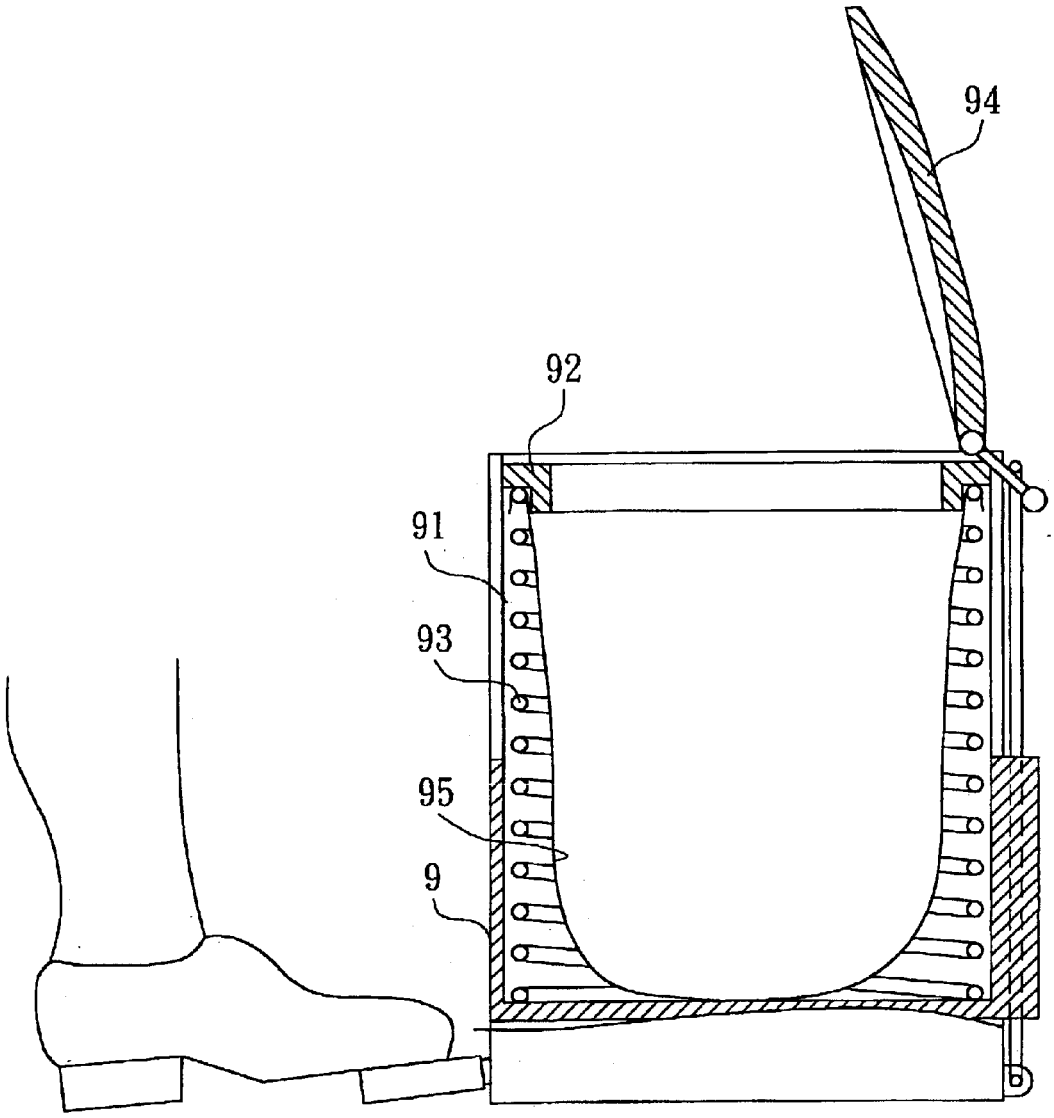
FIG. 17 PRIOR ART
FIG. 17 is a side cross sectional view of another garbage container with a compress device in accordance with the present invention.
Figure 18:
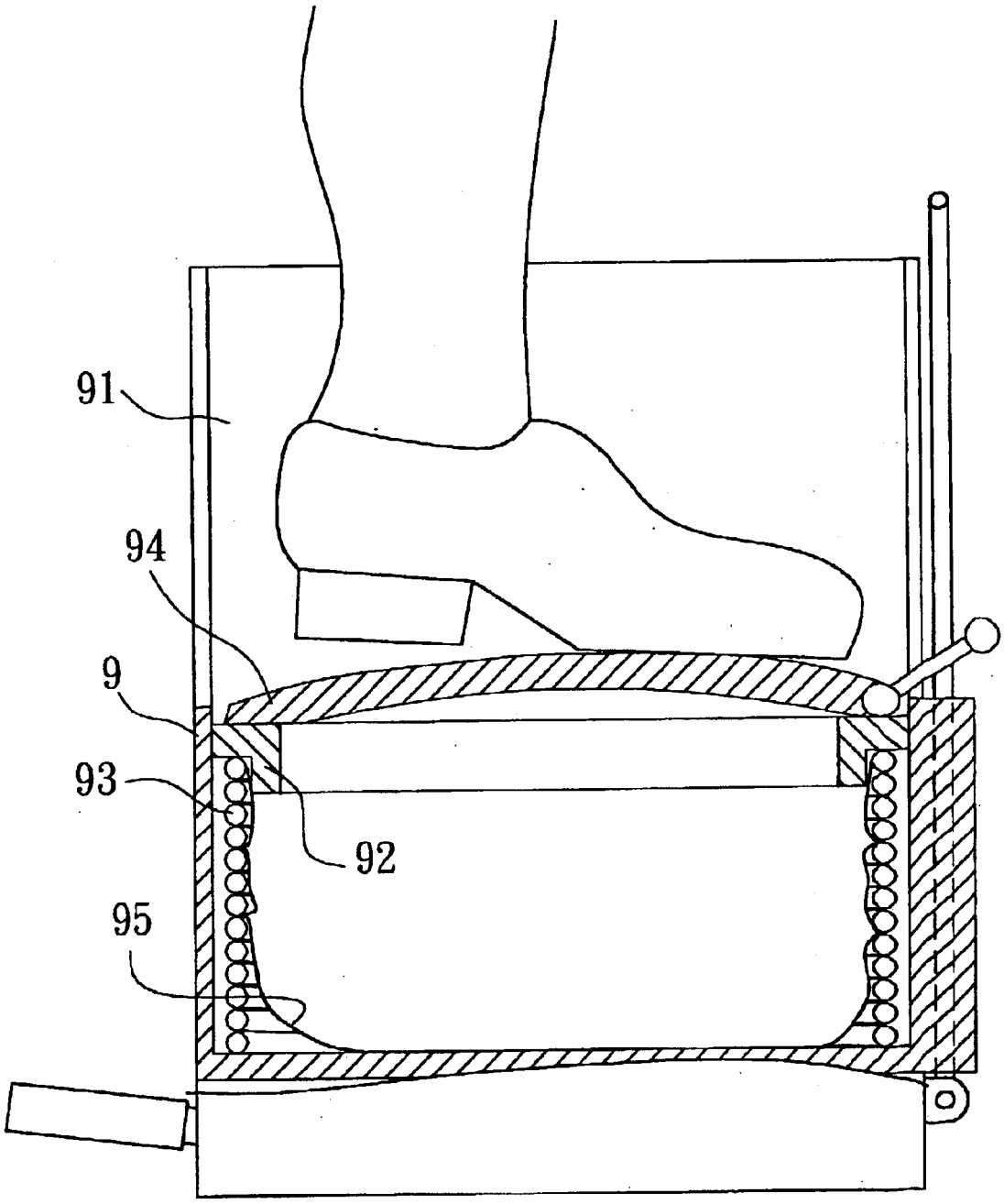
FIG. 18 PRIOR ART
FIG. 18 is a side cross sectional view of the conventional garbage container in FIG. 17 when using the compress device to compress the garbage in the garbage container.

With reference to FIG. 15, the garbage container with a compress device in accordance with the present invention further includes a metal plate (53) attached to a bottom of the compress plate (5) to enhance the structure strength of the compress plate (5) and prevent the compress plate (5) from being penetrated by a sharpened object during compressing the garbage in the garbage container.

Although the invention has been explained in relation to its preferred embodiment, it is to be understood that many other possible modifications and variations can be made without departing from the spirit and scope of the invention as hereinafter claimed.

What is claimed is:

1. A garbage container with a compress device for compressing the garbage received therein, comprising:

a first cylinder having a first receiving space defined therein, a lower close end and an upper open end;

a compress plate reciprocally and movably received in the first cylinder, the compress plate adapted to compress the garbage in the garbage container;

a cover pivotally mounted on a top portion of the first cylinder, the cover having an opening defined therein and communicating with the first receiving space in the first cylinder, the cover including a seat attached to a bottom of the cover and having an opening defined in the seat and corresponding to the opening in the cover, the opening in the cover adapted to allow a user's foot extending into the garbage container to step the compress plate for compressing garbage; and a restituting device mounted in the seat for providing a restitution force to the compress plate after compressing the garbage in the garbage container.

2. The garbage container as claimed in claim 1, wherein first cylinder comprises:

a first pivot seat laterally extending from an outer periphery of the first cylinder for pivotally connected the cover;

a shaft mounted in a bottom of the first cylinder and laterally extending through the cylinder, the shaft having a first end formed with a step portion and a second end opposite to the first end of the shaft; and a linkage having a first pivotally connected to the second of the shaft and a second end pivotally connected to the cover for lifting the cover.

3. The garbage container as claimed in claim 2, wherein the cover has a shape corresponding to that of the first cylinder and includes:

a second pivot seat laterally extending from the cover for pivotally connected to the first pivot seat of the first cylinder;

an annular groove defined in a bottom of the cover and surrounding the opening in the cover such that the seat is snapped into the annular groove;

a first, second, a third and a fourth grooves respectively defined in an upper side of the seat and surrounding the opening in the seat for receiving the restituting device, wherein the first groove corresponds to the third groove and the second groove correspond to the fourth groove;

a first stub upwardly extending from a bottom of the first groove near a first end of the first groove;

a second stub upwardly extending from a bottom of the second groove near a first end of the second groove;

a third stub upwardly extending from a bottom of the third groove near a first end of the third groove;

a fourth stub upwardly extending from a bottom of the fourth groove near a first end of the fourth groove;

a first roller pivotally mounted on the upper side of the seat near a second of the first groove;

a second roller pivotally mounted on the upper side of the seat near a second end of the second groove;

a third roller pivotally mounted on the upper side of the seat near a second end of the third groove; and a fourth roller pivotally mounted on the upper side of the seat near a second end of the fourth groove.

4. The garbage container as claimed in claim 3, wherein the compress plate has a shape corresponding to that of the cover and greater than that of the opening in the cover, and comprises:

a skirt upwardly extending from the compress plate within the opening in the cover; and four sunken holes defined in a bottom of the compress plate and each corresponding to a corresponding one of the first, second, third and the fourth rollers of the cover.

5. The garbage container as claimed in claim 4, wherein the restituting device comprises:

a first resilient member received in the first groove in the seat, the first resilient member having a first end securely connected to the first stub and a second end connected to first end of a first wire, the first wire having a second end extending through the seat and secured in a corresponding one of the four sunken holes in the compress plate after winding the first roller;

a second resilient member received in the second groove in the seat, the second resilient member having a first end securely connected to the second stub and a second end connected to a first end of a second wire, the second wire having a second end extending through the seat and secured in a corresponding one of the four sunken holes in the compress plate after winding the second roller;

a third resilient member received in the third groove in the seat, the third resilient member having a first end securely connected to the third stub and a second end connected to a first end of a third wire, the third wire having a second end extending through the seat and secured in the a corresponding one the four sunken holes in the compress plate after winding the third roller; and a fourth resilient member received in the fourth groove in the seat, the fourth resilient member having a first end securely connected to the fourth stub and a second connected to a first end of a fourth wire, the fourth wire having a second end extending through the seat and secured in a corresponding one of the four sunken holes in the compress plate after winding the fourth roller.

6. The garbage container as claimed in claim 5, wherein the first resilient member, the second resilient member, the third resilient member and the fourth resilient members are springs.

7. The garbage container as claimed in claim 5, wherein the first end and the second end of each of the first wire, the second wire, the third wire and the fourth wire respectively has an end piece mounted thereon, the end piece comprising a first section and a second section longitudinally extending from the first section, the first section having a diameter greater than that of the second section, a sunken hole defined in the end piece for receiving the first/second end of each of the first, the second the third and the fourth wires due to a tie formed on the first/second end of each of the first, the second the third and the fourth wires, the sunken hole in the end piece having a shape corresponding to that of the end piece and extending through the end piece, the end piece mounted on the first end of each of the first, the second the third and the fourth wires being securely received in the second end of each of the first, the second the third and the fourth resilient members, the end piece mounted on the second end of each of the first, the second the third and the fourth wires being received in a corresponding one of the four sunken holes in the compress plate.

8. The garbage container as claimed in claim 6, wherein the first end and the second end of each of the first wire, the second wire, the third wire and the fourth wire respectively has an end piece mounted thereon, the end piece comprising a first section and a second section longitudinally extending from the first section, the first section having a diameter greater than that of the second section, a sunken hole defined in the end piece for receiving the first/second end of each of the first, the second the third and the fourth wires due to a tie formed on the first/second end of each of the first, the second the third and the fourth wires, the sunken hole in the end piece having a shape corresponding to that of the end piece and extending through the end piece, the end piece mounted on the first end of each of the first, the second the third and the fourth wires being securely received in the second end of each of the first, the second the third and the fourth resilient members, the end piece mounted on the second end of each of the first, the second the third and the fourth wires being received in a corresponding one of the four sunken holes in the compress plate.

9. The garbage container as claimed in claim 8, wherein the end piece comprises the end piece comprises a channel longitudinally defined in an outer periphery of the end piece and laterally communicating with the sunken hole in the end piece for easily mounted the first/second end of each of the first, the second, the third and the fourth wires in a corresponding one of the end piece.

10. The garbage container as claimed in claim 4, wherein the compress plate comprises four slots defined therein, each slot parallel to an axis of a corresponding one of the four sunken holes in the compress plate and laterally communicating with a corresponding one of the four sunken holes in the compress plate for easily mounted the second end of each of the first, the second, the third and the fourth wires.

11. The garbage container as claimed in claim 1 further comprising a second cylinder received in the first receiving space in the first cylinder and adapted to receive a bag for receiving the garbage, the second cylinder including a second receiving defined therein, the second cylinder having a lower close end and an open upper end.

12. The garbage container as claimed in claim 2 further comprising a second cylinder received in the first receiving space in the first cylinder and adapted to receive a bag for receiving the garbage, the second cylinder including a second receiving defined therein, the second cylinder having a lower close end and an open upper end.

13. The garbage container as claimed in claim 3 further comprising a second cylinder received in the first receiving space in the first cylinder and adapted to receive a bag for receiving the garbage, the second cylinder including a second receiving defined therein, the second cylinder having a lower close end and an open upper end.

14. The garbage container as claimed in claim 4 further comprising a second cylinder received in the first receiving space in the first cylinder and adapted to receive a bag for receiving the garbage, the second cylinder including a second receiving defined therein, the second cylinder having a lower close end and an open upper end.

15. The garbage container as claimed in claim 5 further comprising a second cylinder received in the first receiving space in the first cylinder and adapted to receive a bag for receiving the garbage, the second cylinder including a second receiving defined therein, the second cylinder having a lower close end and an open upper end.

16. The garbage container as claimed in claim 11 further comprising a third cylinder received in the second receiving space in the second cylinder and adapted to hold open the bag such that the bag is received between the second cylinder and the third cylinder.

17. The garbage container as claimed in claim 12 further comprising a third cylinder received in the second receiving space in the second cylinder and adapted to hold open the bag such that the bag is received between the second cylinder and the third cylinder.

18. The garbage container as claimed in claim 13 further comprising a third cylinder received in the second receiving space in the second cylinder and adapted to hold open the bag such that the bag is received between the second cylinder and the third cylinder.

19. The garbage container as claimed in claim 14 further comprising a third cylinder received in the second receiving space in the second cylinder and adapted to hold open the bag such that the bag is received between the second cylinder and the third cylinder.

20. The garbage container as claimed in claim 15 further comprising a third cylinder received in the second receiving space in the second cylinder and adapted to hold open the bag such that the bag is received between the second cylinder and the third cylinder.

* * * * *